US011043747B2

(12) United States Patent
Mancewicz et al.

(10) Patent No.: US 11,043,747 B2
(45) Date of Patent: Jun. 22, 2021

(54) ANTENNA WITH INTEGRATED BALUN

(71) Applicant: Government of the United States as represented by the Secretary of the Navy, San Diego, CA (US)

(72) Inventors: Steven Edward Mancewicz, San Diego, CA (US); David Walker Brock, San Diego, CA (US); Robert Joseph Motyl, Oceanside, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 225 days.

(21) Appl. No.: 16/437,252

(22) Filed: Jun. 11, 2019

(65) Prior Publication Data

US 2020/0395671 A1 Dec. 17, 2020

(51) Int. Cl.
*H01Q 13/08* (2006.01)
*H01Q 15/16* (2006.01)

(52) U.S. Cl.
CPC ..... *H01Q 13/085* (2013.01); *H01Q 13/08* (2013.01); *H01Q 15/16* (2013.01)

(58) Field of Classification Search
CPC ..... H01Q 13/08; H01Q 13/085
See application file for complete search history.

(56) References Cited

U.S. PATENT DOCUMENTS

| | | | |
|---|---|---|---|
| 3,013,226 | A | 12/1961 | Du Hamel et al. |
| 4,132,993 | A | 1/1979 | Ehrhardt et al. |
| 7,009,572 | B1 | 3/2006 | Homer et al. |
| 9,306,289 | B1 | 4/2016 | Bermeo et al. |
| 2019/0252787 | A1* | 8/2019 | McGrath ..... H01Q 21/064 |

OTHER PUBLICATIONS

Jingjian et al.; Suppression of Cross-Polarization of the Microstrip Integrated Balun-Fed Printed Dipole Antenna; International Journal of Antennas and Propagation; Published Apr. 1, 2014; Hindawi Publishing Corporation.

Duncan, J. W., Minerva, V. P.; 100:1 Bandwidth Balun Transformer; Proceedings of the IRE; Feb. 1960.

(Continued)

*Primary Examiner* — Daniel Munoz
(74) *Attorney, Agent, or Firm* — Naval Information Warfare Center, Pacific; Kyle Eppele; J. Eric Anderson

(57) ABSTRACT

An antenna comprising first and second antenna elements, a center conductor, and a dielectric. The first antenna element is configured to be electrically connected to an outer conductor of a coaxial cable. The center conductor is electrically connected to the second antenna element and configured to be electrically connected to an inner conductor of the coaxial cable. The dielectric is disposed around the center conductor so as to separate the center conductor from the first antenna element. The first antenna element is shaped to gradually surround the dielectric and the center conductor over a length of the first antenna element so as to form a balun, integrated into the first antenna element, that is configured to gradually transform an unbalanced signal in the coaxial cable to a balanced signal that is characteristic of a two-conductor transmission line.

14 Claims, 8 Drawing Sheets

(56) References Cited

OTHER PUBLICATIONS

Hees et al.; Characteristics of a Corrugated Tapered Slot Antenna with Dielectric Rod and Metallic Reflector; Proceedings of the 2008 IEEE International Conference on Ultra-Wideband (ICUWB2008), vol. 1; 2008.

Adamiuk et al.: Dual-orthogonal polarized Vivaldi Antenna for Ultra Wideband Applications; 17th International Conference on Microwaves, Radar and Wireless Communications; 2008.

ETS-Lingren; Open Boundary Quad-Ridged Horns, User Manual; 2007.

Kenyon, Christopher S.; Evaluation of the ETS-Lindgren Open Boundary Quad-Ridged Horn 3164-06; Army Research Laboratory—Technical Report 7272; Apr. 2015.

* cited by examiner

ANTENNA WITH INTEGRATED BALUN

FEDERALLY-SPONSORED RESEARCH AND DEVELOPMENT

The United States Government has ownership rights in this invention. Licensing and technical inquiries may be directed to the Office of Research and Technical Applications, Naval Information Warfare Center Pacific, Code 72120, San Diego, Calif., 92152; voice (619) 553-5118; ssc_pac_t2@navy.mil. Reference Navy Case Number 111106.

BACKGROUND OF THE INVENTION

There is a constantly evolving need for better antennas for a variety of different applications. It can be a struggle to find an antenna that has the appropriate bandwidth, polarization, and/or power handling requirements for a given application in addition to meeting stringent size/weight requirements. For example, prior art attempts at providing broadband, high-power-handling, dual-polarized, directional antennas have employed multiple narrower band antennas to cover the same frequency range or have used multiple single polarization antennas. Significant drawbacks of the multiple antenna approach include high cost and large space requirements due to larger occupied volume. One prior art approach attempted to solve the above-identified drawbacks with a single reflector antenna with a crossed (quad) tapered slot antenna (TSA) with chamfered blade edges, but this approach did not yield satisfactory performance in that the chamfered edges caused the antenna inductance to increase and thus provide a poor impedance match to standard transmission lines. There is a need for an improved antenna.

SUMMARY

Disclosed herein is an antenna comprising first and second antenna elements, a center conductor, and a dielectric. The first antenna element is configured to be electrically connected to an outer conductor of a coaxial cable. The center conductor is electrically connected to the second antenna element and configured to be electrically connected to an inner conductor of the coaxial cable. The dielectric is disposed around the center conductor so as to separate the center conductor from the first antenna element. The first antenna element is shaped to gradually surround the dielectric and the center conductor over a length of the first antenna element so as to form a balun, integrated into the first antenna element, that is configured to gradually transform an unbalanced signal in the coaxial cable to a balanced signal that is characteristic of a two-conductor transmission line.

An embodiment of the antenna described herein may be described as a TSA comprising a dielectric bracket, first and second conductive blades, and a balun. In this embodiment, the first and second conductive blades are mounted to the dielectric bracket so as to define an air gap between edges of the first and second blades thereby forming a TSA. The balun is integrated into the first blade. The integrated balun comprises a center conductor and a dielectric. The center conductor is electrically connected to the second blade. The dielectric surrounds the center conductor and is disposed to electrically insulate the center conductor from the first blade. At a first location on the first blade, the dielectric abuts a bottom edge of the first blade. Over a length of the integrated balun, the first blade gradually surrounds more and more of the dielectric until, at a second location on the first blade, the dielectric is completely surrounded by the first blade so as to gradually transform an unbalanced signal at the second location to a balanced signal that is characteristic of a two-conductor transmission line at the first location.

Also described herein is a method for providing an integrated balun into an antenna comprising the following steps. One step provides for creating a cylindrical hole in a first antenna element from a back edge to a radiating edge. The next step provides for cutting away a portion of the first antenna element along a majority of the length of the hole along a downward-angled plane that is not parallel with the hole that intersects the radiating edge at approximately a top of the hole. The next step provides for inserting a center conductor surrounded by a dielectric through the hole such that the dielectric electrically insulates the center conductor from the first antenna element. The next step provides for electrically connecting the center conductor to a second antenna element.

BRIEF DESCRIPTION OF THE DRAWINGS

Throughout the several views, like elements are referenced using like references. The elements in the figures are not drawn to scale and some dimensions are exaggerated for clarity.

DETAILED DESCRIPTION OF EMBODIMENTS

The disclosed antenna and method for providing an antenna below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other methods and systems described herein as will be understood by one of ordinary skill in the art unless otherwise stated specifically.

Figure 1:
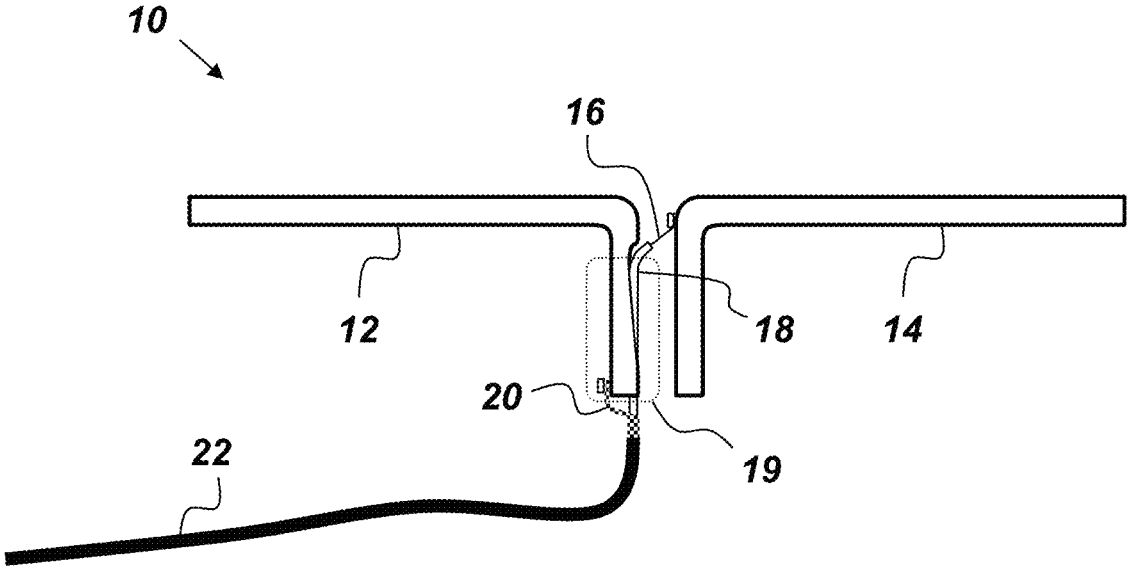
FIG. 1 is an illustration of an embodiment of an antenna with an integrated balun.

FIG. 1 is an illustration of an antenna 10 that comprises, consists of, or consists essentially of a first antenna element 12, a second antenna element 14, a center conductor 16, and a dielectric 18. The first antenna element 12 is shaped to gradually surround the dielectric 18 and the center conductor 16 over a length of the first antenna element 12 so as to form a tapered balun 19 that is integrated into the first antenna element 12. The first and second antenna elements 12 and 14 may be made of any conductive material. A suitable example of material from which the first and second antenna elements 12 and 14 may be made is, but is not limited to, aluminum.

The first antenna element 12 is configured to be electrically connected to an outer conductor 20 of a coaxial cable 22. The center conductor 16 is electrically connected to the second antenna element 14 and is configured to be electrically connected to an inner conductor of the coaxial cable 22. In the embodiment of the antenna 10 shown in FIG. 1, the center conductor 16 is the same as the inner conductor of the coaxial cable 22. The dielectric 18 is disposed around the center conductor 16 so as to separate the center conductor 16 from the first antenna element 12. The balun 19 is configured to gradually transform an unbalanced signal in the coaxial cable 22 to a balanced signal that is characteristic of a two-conductor transmission line. The transition to a balanced, two-conductor transmission line reduces the reflections generated at the point where the inner conductor of the coaxial cable 22 connects to the second antenna element 14. Further, the impedance transform allows for matching the impedance of the transmission line/balun and also allows the first and second antenna elements 12 and 14 to be spaced farther apart than similar prior art antennas that lack a tapered, coaxial balun that is integrated into an antenna element.

Figure 2A:
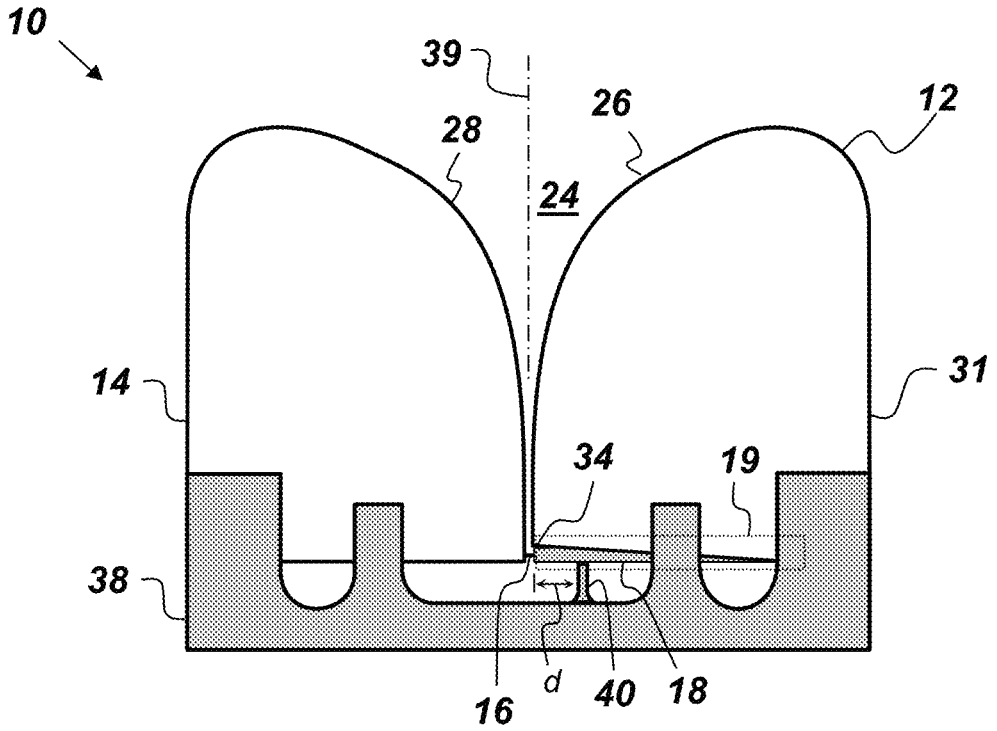
FIG. 2A is a side-view illustration of an embodiment of a tapered slot antenna.
Figure 2B:
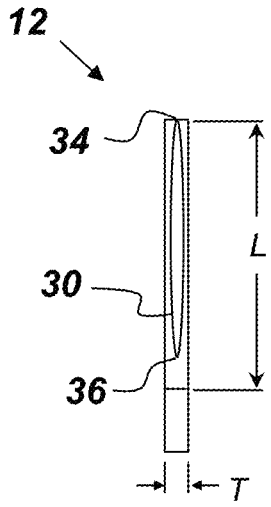
FIGS. 2B and 2C are respectively bottom and side views of a blade of a tapered slot antenna.
Figure 2C:
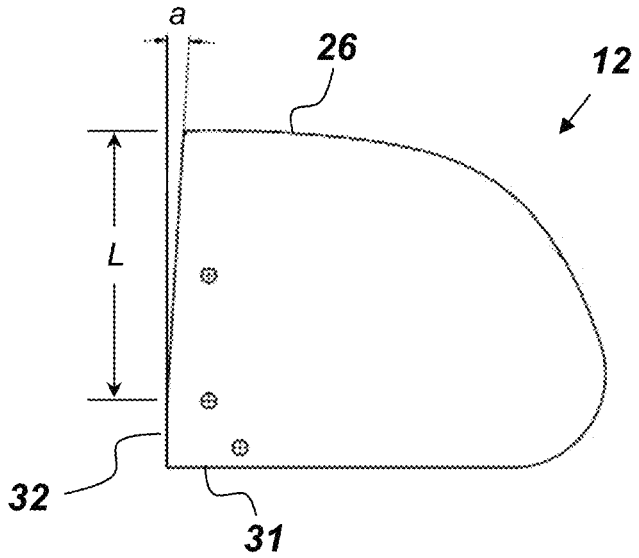

FIG. 2A is a side-view illustration of a tapered slot antenna (TSA) embodiment of the antenna 10. In this embodiment, the first and second antenna elements 12 and 14 are conductive blades of the TSA that are positioned with respect with each other so as to define an air gap or tapered slot 24 between radiating edges 26 and 28 of the first and second blades 12 and 14 respectively. FIGS. 2B and 2C are respectively bottom and side views of an embodiment of the first blade 12 of the TSA embodiment of the antenna 10 shown in FIG. 2A. In this embodiment, the center conductor 16, dielectric 18 and the first blade 12 form a tapered coaxial embodiment of the balun 19 that is integrated into the first blade 12. The balun 19 has wide bandwidth potential with the lower frequency being limited by the length of the taper (~¼ lambda) and the upper frequency being limited by the higher order modes of the coaxial cable 22. To achieve a good match to a typical 50Ω coaxial transmission line (Z=50+0i), the air gap 24 between a single set of TSA elements, having a thickness of 2.54-5.08 millimeters (0.1-0.2 inches), at its narrowest should be approximately ¼ to ⅕ the thickness of the elements. For example, if the elements are 3.175 millimeters (0.125 inches) thick, the gap between elements at the intersection of the bottom edges and the radiating edges should be about 0.762 millimeters (0.03 inches). For thinner blades, the ratio between the thickness of the air gap and the blade thickness may be higher. For example, if the blade thickness is 0.762 millimeters (0.03 inches) the ratio between the narrowest part of the air gap and the blade thickness may be approximately 0.6.

In the TSA embodiment of the antenna 10, the balun 19 enables efficient transition from the unbalanced structure of the coaxial cable 22 to the balanced structure of the first and second elements 12 and 14 without causing unwanted reflected energy in the coaxial cable 22. The integrated balun 19 also transforms the impedance to a higher resistance. Both of these advantages allow the TSA embodiment of antenna 10 to handle higher power than similar prior art antennas that lack an integrated balun. The balun 19 may be formed by creating a cylindrical hole 30 from a back edge 31 to the radiating edge 26 of the first blade 12. Then, a bottom edge 32 of the first antenna element 12 may be cut away at an angle a over a length L. In one embodiment the length L spans a majority of the length of the bottom edge 32 and the hole 30 is cut away along a downward-angled plane that is not parallel with the hole 30 and that intersects the radiating edge 26 at approximately a top of the hole 30. In this embodiment, the degree to which the first antenna element 12 surrounds the dielectric 18 gradually transitions from a first location 34 near the intersection of the radiating edge 26 and the hole 30 of the first antenna element 12 where the dielectric 18 is in tangential contact with the first antenna element 12 to a second location 36 where the first antenna element 12 completely surrounds the dielectric 18. The dielectric 18 is disposed to electrically insulate the center conductor 16 from the first blade 12. The balun 19 serves to gradually transform an unbalanced signal at the second location 36 to a balanced signal that is characteristic of a two-conductor transmission line at the first location 34. In one embodiment of the antenna 10, the length L of the cut is approximately 56 millimeters (~2.2 inches) and the angle a is approximately 3.5° such that at the radiating edge 26, approximately 335° of an inner wall of the hole 30 is cut away, which corresponds to an impedance of ~160Ω. In one example embodiment, the hole 30 has a diameter of 3.58 millimeters (0.141 inches). The integrated balun 19 may be optimized for different applications by varying the angle a and length L of the cut.

Also shown in FIG. 2A is a dielectric bracket 38 configured to hold the first and second blades 12 and 14 in position with respect to each other. The dotted-dashed line 39 represents a centerline that runs through the middle of the air gap 24, or tapered slot, that separates the first and second radiating edges 26 and 28. The dielectric bracket 38 may be constructed of any desired dielectric material. In one suitable example, the dielectric bracket is made of polyoxymethylene. The dielectric bracket 38 shown in FIG. 2A comprises an optional, dielectric support structure 40 that is disposed to maintain a positional relationship between the dielectric 18 and the first blade 12 and to counteract deflection of the dielectric 18 and the center conductor 16 due to gravity. In this embodiment, the dielectric 18 is cylindrical and the area of contact between the dielectric support structure 40 and the dielectric 18 does not exceed a circular, cross-sectional area of the dielectric 18. It is to be understood that the dielectric 18 is not limited to cylindrical shapes, but may be any desired shape. The dielectric support structure 40 is placed a distance d away from the air gap 24. In one embodiment, the distance d is at least 1/24 wavelength (at a lowest intended operating frequency of the antenna 10). In one embodiment, the distance d is at least 15 millimeters away from the air gap 24.

In some embodiments of the antenna 10, the center conductor 16 and the dielectric 18 may be the dielectric sheath and inner conductor of a semi-ridged coaxial cable. For example, with respect to the TSA embodiment of the antenna 10 shown in FIG. 2A, the outer insulative layer and the outer conductor of a semi-rigid coaxial cable may be removed and the remaining dielectric sheath and inner conductor may be pressed into the hole 30. The outer conductor of the coaxial cable would be electrically connected to the first blade 12 and the inner conductor would be electrically connected to the second blade 14.

Figure 3:
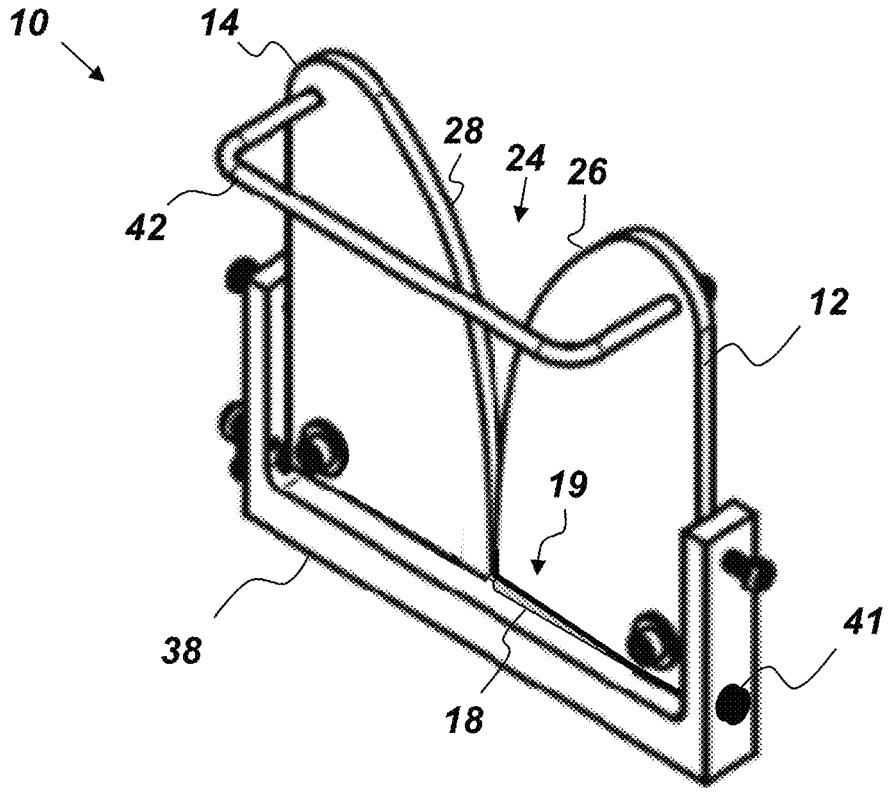
FIG. 3 is a perspective view of an embodiment of a tapered slot antenna.

FIG. 3 is a perspective view of an embodiment of the antenna 10 where the first and second antenna elements 12 and 14 are blades of a TSA and where the antenna 10 further comprises a conductive element 42 electrically connected to both the first and second antenna elements 12 and 14. The conductive element 42 is positioned such that the conductive element 42 spans the tapered slot/air gap 24. Also shown in FIG. 3 is a connector 41 for respectively attaching the outer and inner conductors of a coaxial cable to the first antenna element 12 and the center conductor 16.

Figure 4A:
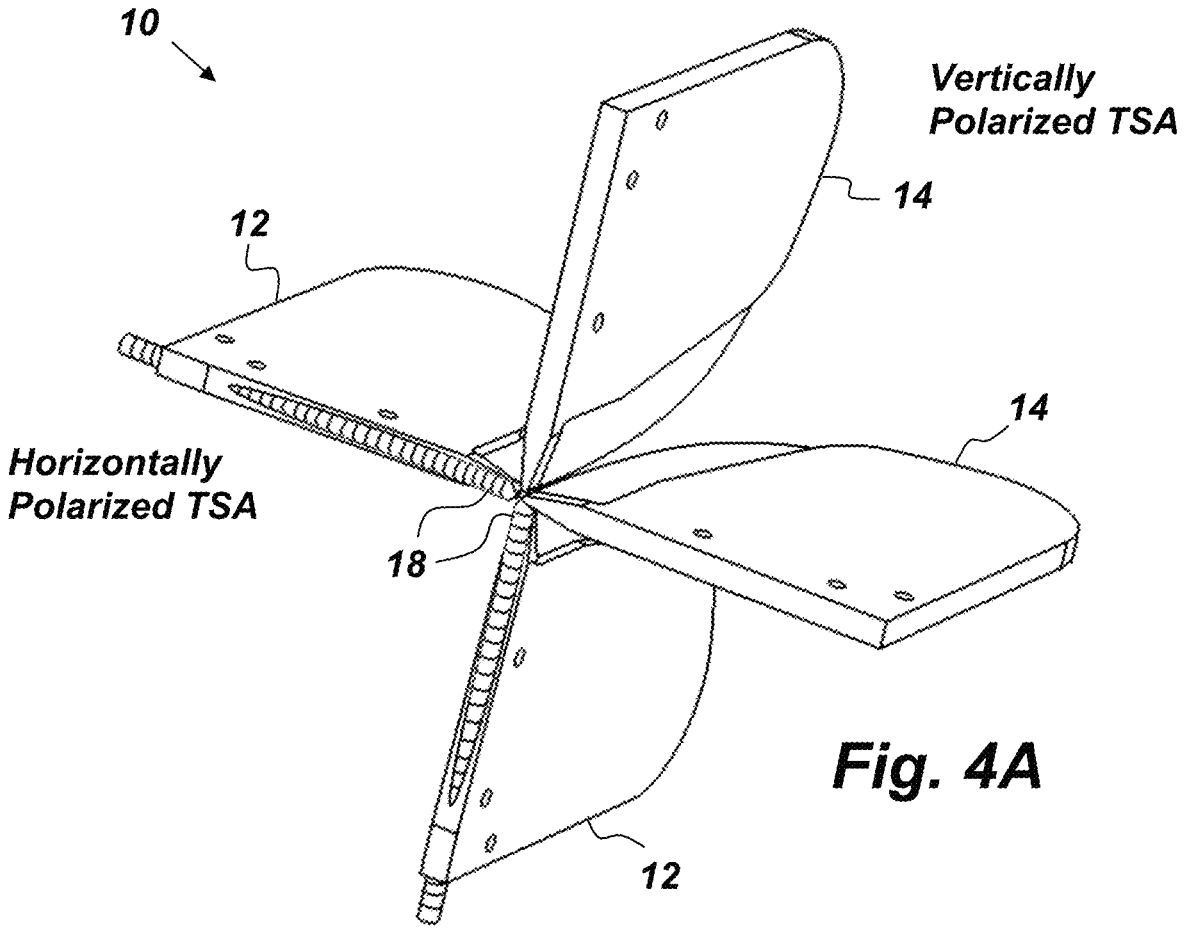
FIG. 4A is a perspective view of an embodiment of a dual-polarization, quad, tapered slot antenna.

FIG. 4A is a perspective view of a dual-polarization, quad, TSA embodiment of the antenna 10 that comprises two sets of first and second antenna elements 12 and 14 arranged with respect to each other to form the blades of two TSAs, one that is horizontally polarized and the other that is vertically polarized. The two TSAs are positioned with respect to one another such that the centerlines (such as the centerline 39 depicted in FIG. 2A) of their air gaps or tapered slots are aligned.

Figure 4B:
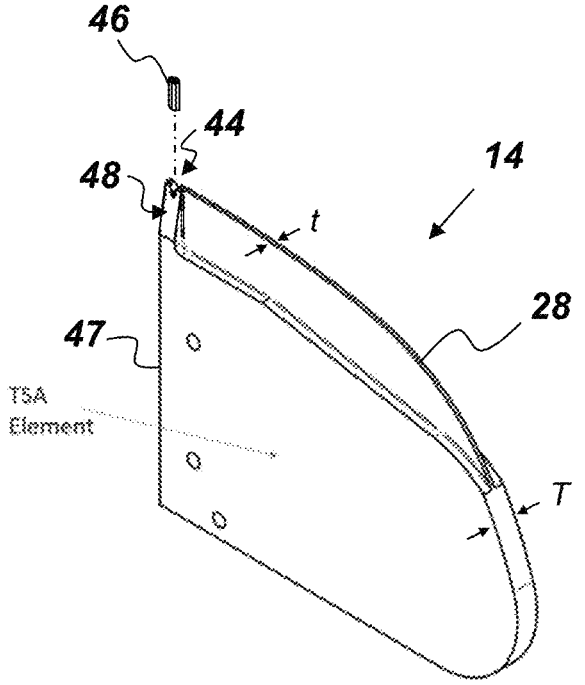
FIG. 4B is a perspective view of a blade of an embodiment of a dual-polarization, quad, tapered slot antenna.

FIG. 4B is a perspective view of one of the second blades 14 of the dual-polarized, quad TSA embodiment of the antenna 10 shown in FIG. 4A. In this embodiment, a part of each of the radiating edges 26 and 28 (i.e., the tapered-slot-defining edges) of the vertically-polarized TSA and the horizontally-polarized TSA has a thinned-edge portion that has a thickness t that is non-tapered and stepwise-reduced from the thickness T of a non-thinned portion of the corresponding blade. In this embodiment, a section of the thinned-edge portion of antenna element 14 is non-tapered and stepwise-reduced for at least 12 millimeters (0.49 inches) from the radiating/slot-defining edge 28 as measured perpendicularly from the radiating edge 28. In one example embodiment, t is 0.762 millimeters (0.03 inches) and T is 4.826 millimeters (0.19 inches). In this embodiment, the tapered slots or air gaps 24 have a narrowest dimension that is approximately 0.6 of the thickness t of the thinned edge portion of the first and second blades 12 and 14.

FIG. 4B also shows a receiving hole 44 in the radiating edge 28 of the second antenna element 14, into which the center conductor 16 may be inserted. This embodiment of the antenna 10 further comprises a retainer 46 configured to hold the center conductor 16 in the receiving hole 44 so as to maintain electrical connectivity between the center conductor 16 and the second antenna element 14. In one embodiment, the center of the receiving hole 44 is positioned 1.9 mm (0.075 inches) from the bottom 47 of the second antenna element 14. Suitable examples of the retainer 46 include, but are not limited to, a spring, a retaining pin, and a set screw. In the embodiment of the second antenna element 14 shown in FIG. 4B, the retainer 46 is an electrically conductive insert that is pressed into the receiving hole 44 and comprises a female feature for receiving, and maintaining electrical contact with, the center conductor 16. Any portions of the retainer 46 that extend beyond the outer surfaces of the second antenna element 14, such as surface 48 shown in FIG. 4B, may be made flush with the second antenna element 14. In some embodiments, the retainer 46 may be disposed in a recess in the second antenna element 14, which recess may be subsequently filled with a conductive substance such as silver epoxy. The conductive substance filling the recess may be smoothed to conform with the outer surfaces of the second antenna element 14, such as the side surface 48 and the radiating edge 28. The smoothing of the conductive substance to conform with the outer surfaces of the second antenna element 14 had an unexpectedly large impact on the performance (specifically reducing the return loss) of a prototype embodiment of the antenna 10.

Figure 5A:
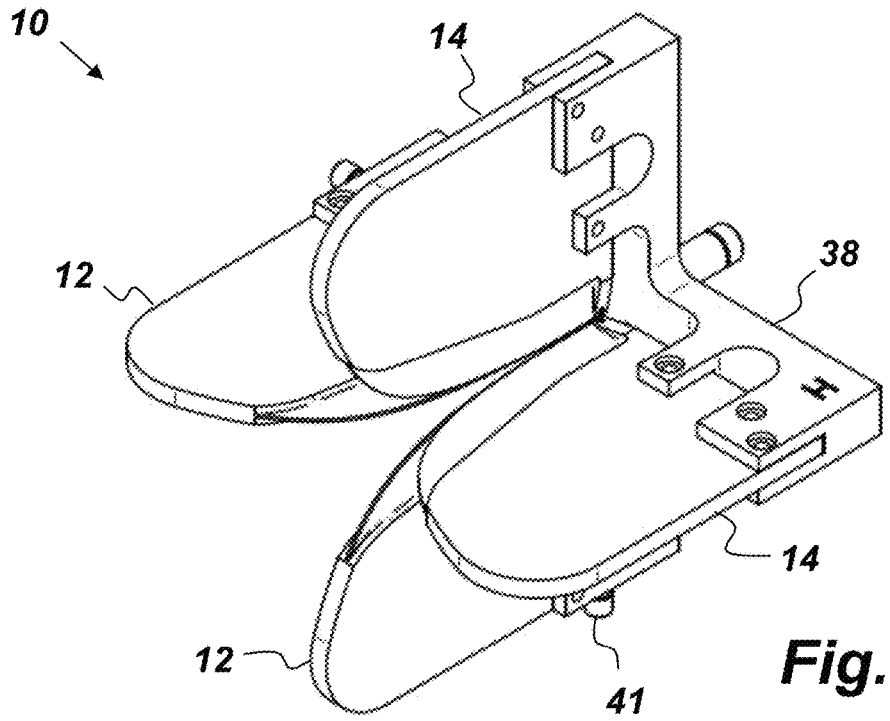
FIGS. 5A, 5B, and 5C are respectively perspective, side, and top views of an embodiment of a dual-polarized, quad, tapered slot antenna.
Figure 5B:
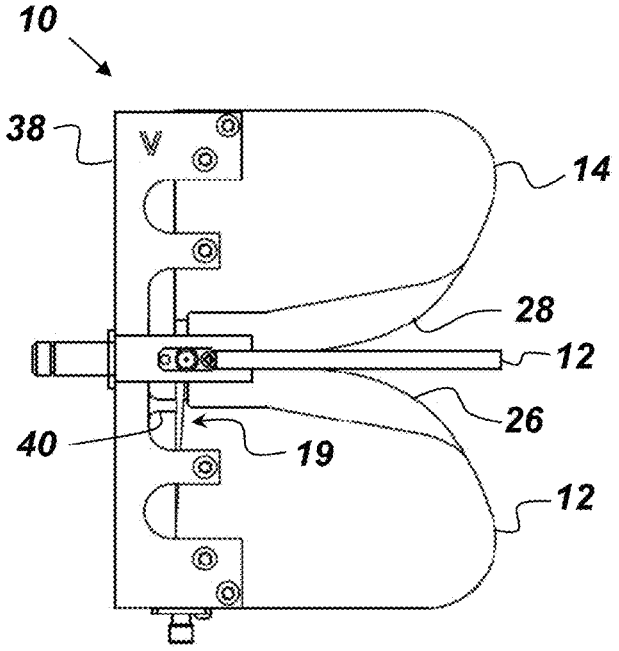
Figure 5C:
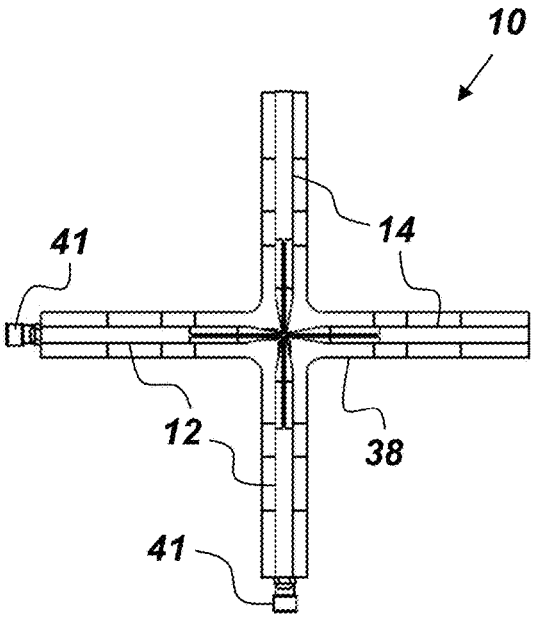

FIGS. 5A, 5B, and 5C are respectively perspective, side, and top views of a dual-polarized, quad TSA embodiment of the antenna 10. In this embodiment, parts of the radiating edges 26 and 28 have thinned portions as described above with respect to FIGS. 4A and 4B. Antenna 10 may be integrated into a high power broadband transceiver system. The dual-polarized TSA embodiment of the antenna 10 is capable of receiving or transmitting high power radio frequency energy on dual linear polarizations simultaneously (or other single polarizations such linear, right-hand circular, or left-hand circular) over a greater bandwidth than that which is achievable by prior art antennas. Thinning the blade, as depicted in FIGS. 4A, 4B, 5A-5C, did not cause the inductance of the antenna 10 to increase the way a chamfer does and thus is able to provide a good impedance match to typical transmission lines over more broad frequency ranges than the prior art. A better impedance match has the advantage of higher power handling capability and higher overall antenna efficiency.

Figure 6A:
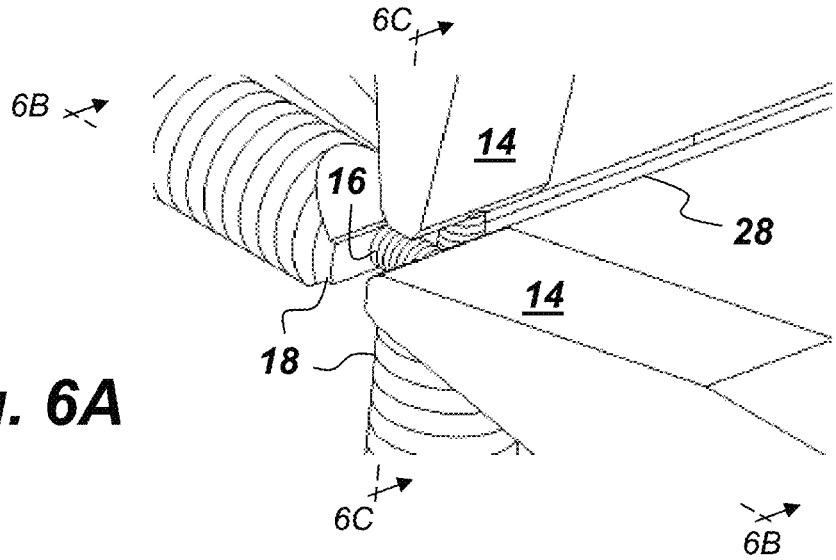
FIG. 6A is a close-up, perspective view of a bottom, center section of an embodiment of a dual-polarized, quad, tapered slot antenna.
Figure 6B:
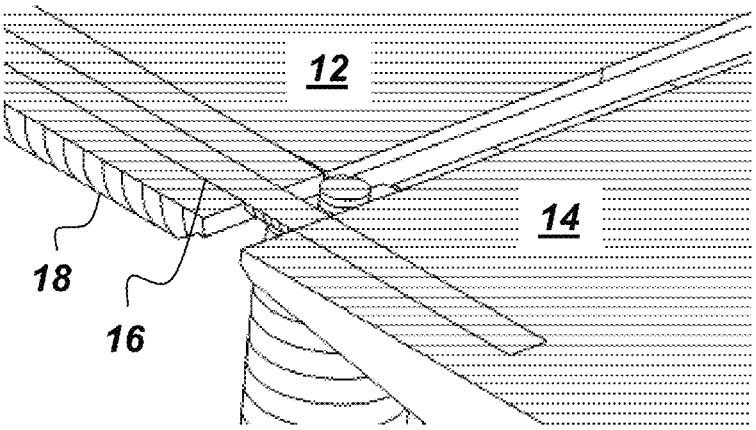
FIGS. 6B and 6C are cross-sectional views of the close-up, perspective view of the bottom, center section of the antenna shown in FIG. 6A.
Figure 6C:
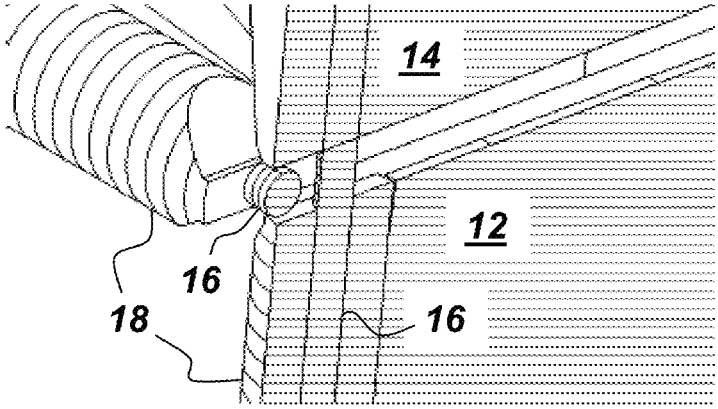

FIG. 6A is a close-up, perspective view of a bottom, center section of the dual-polarized, quad TSA embodiment of the antenna 10. FIGS. 6B and 6C are cross-sectional views of the close-up, perspective view of the bottom, center section of the dual-polarized, quad TSA embodiment of the antenna 10 shown in FIG. 6A.

Figure 7:
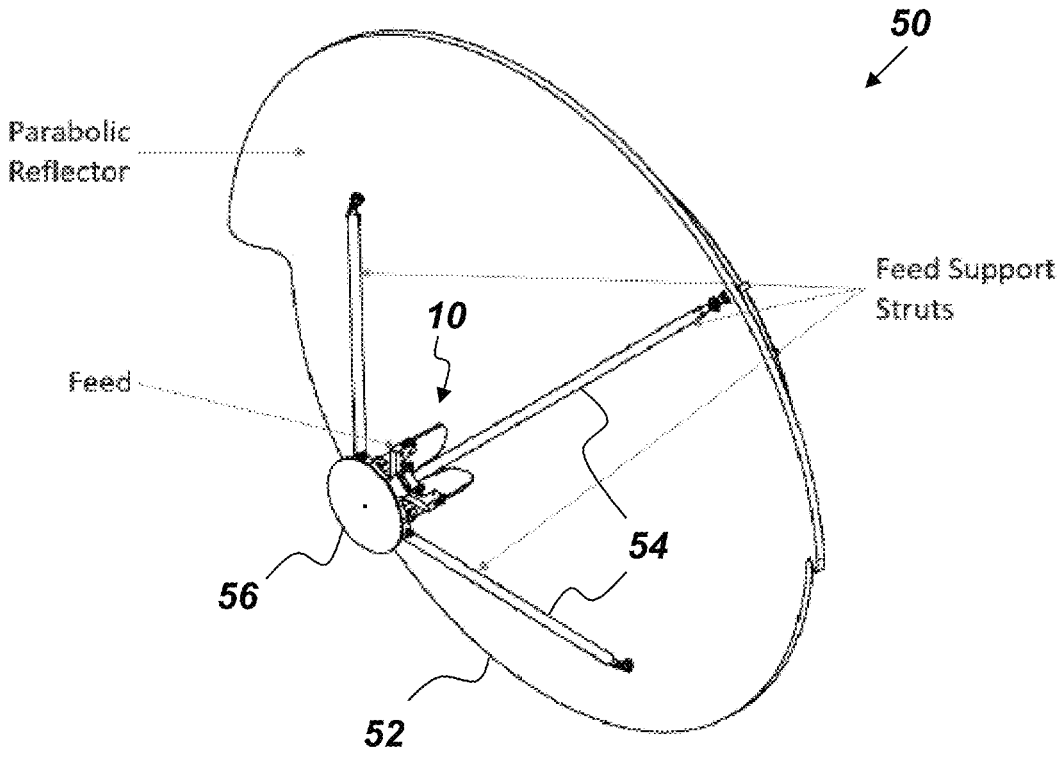
FIG. 7 is a perspective view of an embodiment of a prime focus fed parabolic antenna.

FIG. 7 is a perspective view of a prime focus fed parabolic (PFFP) antenna 50 that uses the dual-polarized, quad TSA embodiment of the antenna 10 shown in FIG. 5A, as an antenna feed. In this embodiment, a reflector 52 is connected with feed support struts 54 to the dual-polarized, quad TSA embodiment of the antenna 10. The PFFP antenna 50 shown in FIG. 7 may be used with high power (i.e., >200 W on each polarization) wideband (i.e., >20:1 bandwidth) transceiver systems with the ability to transmit or receive vertical and horizontal polarizations simultaneously. With an additional feeding circuit, as is known in the art, antenna 10 can also produce any linear polarization angle, or right hand or left hand circular polarization. The overall gain performance of the PFFP antenna 50 may be determined by the performance of its feed along with how that feed's radiation pattern interacts with the parabolic reflector 52 and support structures 54. The overall voltage standing wave ratio (VSWR) and power handling performance are almost entirely determined by the performance of the antenna's feed. As mentioned above, in this embodiment, the dual-polarized, quad TSA embodiment of the antenna 10 serves as the antenna feed for the PFFP antenna 50. In this embodiment, the antenna feed (i.e., the dual-polarized, quad TSA embodiment of the antenna 10) meets the performance requirements shown in Table 1 below

TABLE 1

Performance Requirements met bv the dual-polarized, quad TSA embodiment of the antenna 10.

| Parameter | Performance Requirement |
|---|---|
| Polarization | Two port -vertical and horizontal elements |
| Frequency Range | >20:1 bandwidth |
| Power | 200 W continuous wave (CW) on each port |
| Voltage Standing Wave Ratio (VSWR) | ≤2.3:1 |
| Directivity | Optimized for even dish illumination over frequency range ~30deg BW |
| Phase Center | Remain relatively stable across frequency range |

The PFFP antenna 50 may further comprise a conductive disk 56 placed approximately ¼ wavelength (at the lowest intended operating frequency) behind the quad-TSA 10. The conductive disk 56 is electrically insulated from the antenna elements 12 and 14 and is mounted coaxially with the parabolic reflector such that the antenna elements 12 and 14 are disposed between the conductive disk 56 and the parabolic reflector 52. The conductive disk 56 serves as a reflector element that improves the low frequency gain of the antenna 10. In one embodiment, the conductive disk 56 is a flat 15.25-centimeter (6-inch) diameter disk located 7.62 centimeters (3 inches) behind the first and second antenna elements 12 and 14 that adds about 2 dB of forward gain at the lowest frequencies. The conductive disk 56 was found to have negligible effect on higher frequency performance of the PFFP antenna 50.

Figure 8:
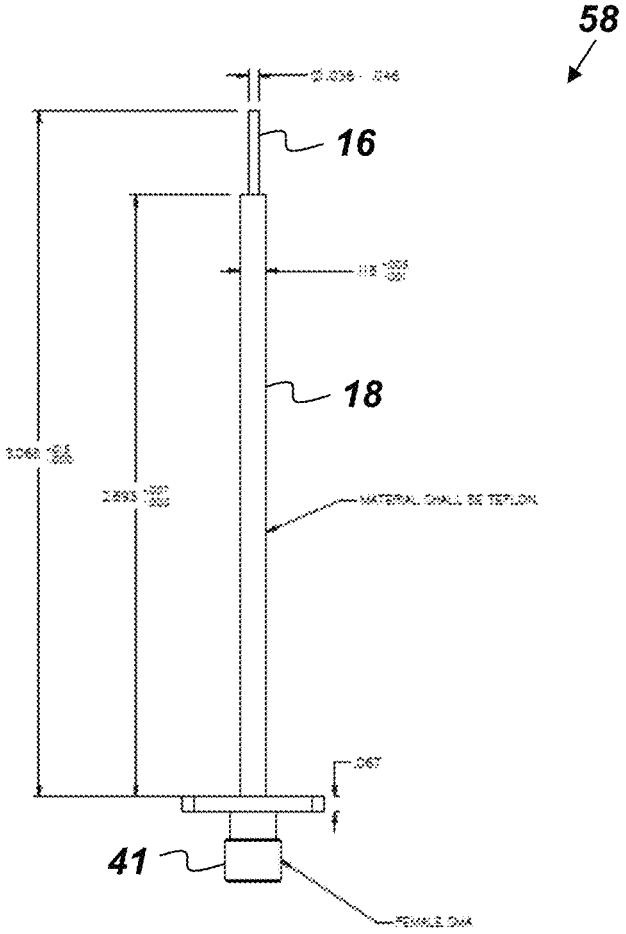
FIG. 8 is a side view of a cable insert of an integrated balun.

FIG. 8 is a drawing of an embodiment of a cable insert 58 that may form part of the balun 19. The cable insert 58 comprises the center conductor 16, the dielectric 18, and the connector 41, which may be attached to a coaxial cable. The connector 41 may be attached to the back edge 31 of the first antenna element 12 such that the dielectric 18 and center conductor 16 are routed through the hole 30.

From the above description of the antenna 10, it is manifest that various techniques may be used for implementing the concepts of the antenna 10 without departing from the scope of the claims. The described embodiments are to be considered in all respects as illustrative and not restrictive. The method/apparatus disclosed herein may be practiced in the absence of any element that is not specifically claimed and/or disclosed herein. It should also be understood that the antenna 10 is not limited to the particular embodiments described herein, but is capable of many embodiments without departing from the scope of the claims.

We claim:

1. An antenna comprising:

first and second antenna elements, wherein the first antenna element is configured to be electrically connected to an outer conductor of a coaxial cable;

a center conductor electrically connected to the second antenna element and configured to be electrically connected to an inner conductor of the coaxial cable; and a dielectric disposed around the center conductor so as to separate the center conductor from the first antenna element, wherein the first antenna element is shaped to gradually surround the dielectric and the center conductor over a length of the first antenna element so as to form a balun, integrated into the first antenna element, that is configured to gradually transform an unbalanced signal in the coaxial cable to a balanced signal that is characteristic of a two-conductor transmission line.

2. The antenna of claim 1, wherein a degree to which the first antenna element surrounds the dielectric gradually transitions from a first location on a radiating edge of the first antenna element where the dielectric is in tangential contact with the first antenna element to a second location where the first antenna element completely surrounds the dielectric.

3. The antenna of claim 2, further comprising a dielectric bracket configured to hold the first and second antenna elements in position with respect to each other, and wherein the dielectric bracket comprises a dielectric support structure disposed to maintain a positional relationship between the dielectric and the first conductive element.

4. The antenna of claim 3, wherein the dielectric is cylindrical and wherein an area of contact between the dielectric support structure and the dielectric does not exceed a circular, cross-sectional area of the dielectric.

5. The antenna of claim 3, wherein the blades of the tapered slot antenna are positioned with respect to each other so as to define a tapered slot therebetween, and wherein the dielectric support structure is positioned away from any part of the tapered slot by at least 1/24 wavelength of a lowest operating frequency of the antenna of claim 3.

6. The antenna of claim 2, wherein a portion of the center conductor is inserted into a receiving hole in the second antenna element, and the antenna further comprises a retainer configured to hold the center conductor in the receiving hole, and wherein a head of the retainer is flush with a surface of the second antenna element.

7. The antenna of claim 1, wherein the first and second antenna elements are blades of a tapered slot antenna.

8. The antenna of claim 7, further comprising:

third and fourth antenna elements configured in the same manner as the first and second elements, wherein the third and fourth antenna elements are mounted orthogonal to the first and second antenna elements so as to form a dual-polarized, quad, tapered-slot antenna; and wherein edges of the first and second antenna elements are positioned with respect to each other so as to define a first tapered slot, and edges of the third and fourth antenna elements are positioned with respect to each other so as to define a second tapered slot, and wherein at least part of each of the slot-defining edges has a thickness that is non-tapered and stepwise-reduced from the thickness of a remainder of the corresponding blade.

9. The antenna of claim 8, further comprising a parabolic reflector positioned such that the first and second tapered slots are approximately in a focal position of the parabolic reflector.

10. The antenna of claim 9 further comprising a conductive disk electrically insulated from the antenna elements and mounted coaxially with the parabolic reflector such that the antenna elements are disposed between the conductive disk and the parabolic reflector.

11. The antenna of claim 7, wherein the blades of the tapered slot antenna are positioned with respect to each other so as to define a tapered slot therebetween, and the antenna further comprises a conductive element electrically connected to both the first and second antenna elements and positioned such that the conductive element spans the tapered slot.

12. A tapered slot antenna (TSA) comprising:

a dielectric bracket;

first and second conductive blades mounted to the dielectric bracket so as to define an air gap between edges of the first and second blades thereby forming a TSA; and a balun integrated into the first blade, wherein the integrated balun comprises a center conductor electrically connected to the second blade, a dielectric surrounding the center conductor and disposed to electrically insulate the center conductor from the first blade, and wherein at a first location on the first blade the dielectric abuts a bottom edge of the first blade and over a length of the integrated balun the first blade gradually surrounds more and more of the dielectric until, at a second location on the first blade, the dielectric is completely surrounded by the first blade so as to gradually transform an unbalanced signal at the second location to a balanced signal that is characteristic of a two-conductor transmission line at the first location.

13. The TSA of claim 12, wherein the air gap has a narrowest dimension that is approximately one fourth to one fifth the thickness of the blades.

14. The TSA of claim 12, wherein the center conductor and dielectric of the integrated balun are sourced from a coaxial cable.

* * * * *